US009115333B2

(12) United States Patent
Kase et al.

(10) Patent No.: US 9,115,333 B2
(45) Date of Patent: Aug. 25, 2015

(54) METHOD FOR MANUFACTURING REFINED FATS AND OILS

(75) Inventors: Minoru Kase, Kamisu (JP); Toshiteru Komatsu, Kamisu (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 14/126,635

(22) PCT Filed: Jun. 14, 2012

(86) PCT No.: PCT/JP2012/065796

§ 371 (c)(1),
(2), (4) Date: Dec. 16, 2013

(87) PCT Pub. No.: WO2012/173281

PCT Pub. Date: Dec. 20, 2012

(65) Prior Publication Data

US 2014/0121397 A1 May 1, 2014

(30) Foreign Application Priority Data

Jun. 15, 2011 (JP) ..... 2011-132763

(51) Int. Cl.

| | |
|---|---|
| ***C11B 3/00*** | (2006.01) |
| ***C11B 3/10*** | (2006.01) |
| ***C11B 3/14*** | (2006.01) |

(52) U.S. Cl.

CPC . *C11B 3/10* (2013.01); *C11B 3/001* (2013.01); *C11B 3/14* (2013.01)

(58) Field of Classification Search

CPC ..... C07C 67/56; C11B 3/10; C11B 3/06; C11B 3/001; C11C 1/08
USPC ..... 554/191, 192
See application file for complete search history.

(56) References Cited

U.S. PATENT DOCUMENTS

| | | | | |
|---|---|---|---|---|
| 2,454,937 | A * | 11/1948 | Moyer et al. | 426/541 |
| 4,089,880 | A | 5/1978 | Sullivan | |
| 4,125,482 | A | 11/1978 | Sinha | |
| 4,150,045 | A * | 4/1979 | Sinha | 554/190 |
| 4,443,379 | A * | 4/1984 | Taylor et al. | 554/191 |
| 4,599,143 | A | 7/1986 | Stage | |
| 4,601,790 | A | 7/1986 | Stage | |
| 2011/0206804 | A1 | 8/2011 | Kase et al. | |
| 2012/0177791 | A1 | 7/2012 | Kase et al. | |
| 2012/0258232 | A1 | 10/2012 | Kase et al. | |
| 2013/0012733 | A1 | 1/2013 | Abe et al. | |
| 2013/0012734 | A1 | 1/2013 | Fukuhara et al. | |

FOREIGN PATENT DOCUMENTS

| | | | |
|---|---|---|---|
| CA | 2 782 551 | A1 | 6/2011 |
| CN | 1192772 | A | 9/1998 |
| CN | 1312850 | A | 9/2001 |
| CN | 101517057 | A | 8/2009 |
| EP | 2 175 030 | | 4/2010 |
| JP | 2-307526 | A | 12/1990 |
| JP | 3 7240 | | 2/1991 |
| JP | 4 261497 | | 9/1992 |
| JP | 2002 121581 | | 4/2002 |
| JP | 2009 40854 | | 2/2009 |
| JP | 2011 63702 | | 3/2011 |
| JP | 2011 144343 | | 7/2011 |
| JP | 2011 195621 | | 10/2011 |
| JP | 2011 195622 | | 10/2011 |
| WO | 2010 126136 | | 11/2010 |

OTHER PUBLICATIONS

Written Opinion of the International Searching Authority Issued Aug. 22, 2012 in PCT/JP12/065796 Filed Jun. 14, 2012.
International Search Report Issued Aug. 22, 2012 in PCT/JP12/065796 Filed Jun. 14, 2012.

* cited by examiner

*Primary Examiner* — Deborah D Carr
(74) *Attorney, Agent, or Firm* — Oblon, McClelland, Maier & Neustadt, L.L.P.

(57) ABSTRACT

Provided is a method for manufacturing refined fats and oils with less by-products, good taste and flavor and hue, and reduced smoke generation. The method for manufacturing refined fats and oils includes: (1) carrying out an adsorption treatment of bringing fats and oils into contact with clay (A) and at least one kind of alkaline earth metal salt (B) selected from the group consisting of an oxide, a carbonate, and a silicate of an alkaline earth metal; and (2) subsequently carrying out a deodorization treatment of bringing the resultant fats and oils into contact with water vapor at 180° C. or less.

24 Claims, No Drawings

METHOD FOR MANUFACTURING REFINED FATS AND OILS

CROSS REFERENCE TO RELATED APPLICATION

This application is a 371 of PCT/JP2012/065796, filed on Jun. 14, 2012, and claims priority to Japanese Patent Application No. 2011-132763, filed on Jun. 15, 2011.

FIELD OF THE INVENTION

The present invention relates to a method for manufacturing refined fats and oils.

BACKGROUND OF THE INVENTION

Fats and oils are essential for a human body as nutrients and source of energy supply (the primary function), and moreover, are important for providing so-called sensory function (the secondary function), which satisfies food preferences, for example, taste or aroma. In addition, fats and oils containing diacylglycerols at a high concentration are known to show physiological effects (the third function) such as body fat-burning effect.

Untreated fats and oils obtained by squeezing seeds, germs, pulp, and the like of plants contain, for example, fatty acids, monoacylglycerols, and odor components. Further, when the untreated fats and oils are processed, trace components are generated as by-products through a heating step such as a transesterification reaction, an esterification reaction, or a hydrogenation treatment, resulting in deterioration of the taste and flavor of the resultant fats and oils. Thus, a process of so-called deodorization, in which the fats and oils are brought into contact with water vapor under a reduced pressure at a high temperature, is generally performed (Patent Document 1).

Further, in order to treat diacylglycerol-rich fats and oils, it is reported to adopt a method involving adding an organic acid to fats and oils rich in diacylglycerols and subsequently carrying out a decoloration treatment and a deodorization treatment with a porous adsorbent, so as to provide good taste and flavor (Patent Document 2), or a method involving carrying out an esterification reaction between glycerin and each of fatty acids obtained by hydrolyzing raw material fats and oils by an enzymatic decomposition method and subsequently carrying out a deodorization treatment so that a deodorization time and a deodorization temperature can be each controlled in a given range (Patent Document 3).

PRIOR ART DOCUMENT

Patent Document

[Patent Document 1] JP-B-H03-7240
[Patent Document 2] JP-A-H04-261497
[Patent Document 3] JP-A-2009-40854
[Patent Document 4] WO 2010/126136 A1

SUMMARY OF THE INVENTION

The present invention provides a method for manufacturing refined fats and oils, including: (1) carrying out an adsorption treatment of bringing fats and oils into contact with clay (A) and at least one kind of alkaline earth metal salt (B) selected from the group consisting of an oxide, a carbonate, and a silicate of an alkaline earth metal; and (2) subsequently carrying out a deodorization treatment of bringing the resultant fats and oils into contact with water vapor at 180° C. or less.

DETAILED DESCRIPTION OF THE INVENTION

In recent years, consumer demand for improvement of quality of edible fats and oils has been largely growing, and consumers who are sensitive to taste and flavor and appearances have been remarkably increased. Thus, fats and oils having higher purity and better taste and flavor and hue than conventional ones are desired.

However, it has been found that a conventional process of deodorization, which has been performed for improving the taste and flavor, may even increase the amount of by-products. That is, when a deodorization treatment is carried out at a low temperature, an effect of distilling odor components is small, resulting in fats and oils having poor taste and flavor and hue, and hence the deodorization treatment needs to be carried out at a high temperature, but it has been found that glycidol fatty acid esters are generated as different by-products at a high temperature. In particular, fats and oils rich in diacylglycerols have shown such tendency remarkably.

A method involving treating fats and oils with an adsorbent and/or an alkali in advance before a deodorization treatment is known as means for suppressing generation of glycidol fatty acid esters or the like in fats and oils (Patent Document 4). However, the taste and flavor of fats and oils obtained by the method of Patent Document 4 are unknown, and it is necessary to develop a technology for additionally improving the taste and flavor because the deodorization treatment is carried out at a high temperature even in the final step.

On the other hand, when the deodorization treatment is carried out at a low temperature, the taste and flavor and hue are improved insufficiently although generation of by-products can be suppressed to some extent. In addition, the smoke point lowers. A method for solving all the problems has not been found yet.

Therefore, the present invention relates to a method for manufacturing refined fats and oils with less by-products, good taste and flavor and hue, and reduced smoke generation.

The inventor of the present invention has made extensive studies on operations for refining fats and oils, and has found that generation of by-products is suppressed by carrying out a treatment of bringing fats and oils into contact with clay and an alkaline earth metal salt in advance and subsequently carrying out a treatment of bringing the fats and oils into contact with water vapor under mild conditions, and that the fats and oils obtained through such treatments have good taste and flavor and hue, and exhibit reduced smoke generation when heated.

According to the present invention, there is provided refined fats and oils with less by-products, good taste and flavor and hue, and reduced smoke generation when heated.

A method for manufacturing refined fats and oils of the present invention includes the following steps (1) and (2).

Step (1): an adsorption treatment of bringing fats and oils into contact with clay (A) and at least one kind of alkaline earth metal salt (B) selected from the group consisting of an oxide, a carbonate, and a silicate of an alkaline earth metal.

Step (2): a deodorization treatment of bringing the fats and oils obtained in the step (1) into contact with water vapor at 180° C. or less.

Herein, the fats and oils encompass fats and oils containing triacylglycerols and diacylglycerols. That is, in the step (1) of the present invention, fats and oils containing triacylglycerols or diacylglycerols are used.

There is a tendency that diacylglycerols are liable to generate by-products as compared to triacylglycerols in a refining step. Thus, it is more preferred that the manufacturing method of the present invention be applied to fats and oils containing diacylglycerols. The content of diacylglycerols in fats and oils is preferably 20% by mass (hereinafter, simply referred to as "%") or more, more preferably 50% or more, and even more preferably 70% or more. The upper limit of the content is not particularly defined, but is preferably 99% or less, more preferably 98% or less, and even more preferably 97% or less. Specifically, preferred are fats and oils containing diacylglycerols in an amount of preferably 20 to 99%, more preferably 50 to 99%, and even more preferably 70 to 99%.

The fats and oils containing diacylglycerols can be obtained through an esterification reaction between fatty acids, derived from raw material fats and oils, and glycerin, a glycerolysis reaction between raw material fats and oils and glycerin, or the like.

The esterification reaction and/or glycerolysis reaction are/is broadly classified into chemical methods using a chemical catalyst such as an alkali metal or an alloy thereof, or an oxide, a hydroxide, or an alkoxide having 1 to 3 carbon atoms of an alkali metal or an alkaline earth metal, and enzymatic methods using an enzyme such as a lipase. Among them, the reactions are preferably carried out under enzymatically mild conditions by using a lipase or the like as the catalyst in view of obtaining excellent taste and flavor or the like.

The raw material fats and oils may be any of vegetable fats and oils and animal fats and oils. Specific examples of the raw material fats and oils include rapeseed oil, sunflower oil, corn oil, soybean oil, rice oil, safflower oil, cottonseed oil, beef tallow, linseed oil, and fish oil.

The upper limit of the content of triacylglycerols in the raw material fats and oils is not particularly defined, but is preferably 85% or more, more preferably 90% or more, and even more preferably 95% or more.

The raw material fats and oils are preferably used after a deodorization treatment from the viewpoint of improving the hue and taste and flavor. Herein, the deodorization treatment for the raw material fats and oils is referred to as "preliminary deodorization treatment." The preliminary deodorization treatment is a steam distillation treatment for the raw material fats and oils, and steam distillation under reduced pressure is preferred from the viewpoint of the efficiency of deodorization.

The preliminary deodorization treatment may be performed by a batch method, a semi-continuous method, a continuous method, or the like. When the amount of fats and oils to be treated is small, the batch method is preferably used, and when the amount is large, the semi-continuous method or the continuous method is preferably used.

Example of apparatus for the semi-continuous method includes a Girdler type deodorization apparatus composed of a deodorization tower equipped with several trays. The treatment is performed in this apparatus by supplying fats and oils for deodorization from the upper part of the apparatus, bringing the fats and oils into contact with water vapor in a tray for an appropriate period of time, and supplying the fats and oils to the next lower tray so that the fats and oils are successively moved down intermittently.

Example of apparatus for the continuous method includes a thin-film deodorization apparatus filled with structures in which fats and oils in a thin-film form can be brought into contact with water vapor.

The temperature at which the raw material fats and oils are brought into contact with water vapor is preferably 180 to 250° C., more preferably 190 to 240° C., even more preferably 200 to 230° C., and even more preferably 210 to 230° C.

The time for which the raw material fats and oils are brought into contact with water vapor is preferably 10 to 180 minutes, more preferably 15 to 120 minutes, and even more preferably 20 to 90 minutes.

The pressure at which the raw material fats and oils are brought into contact with water vapor is preferably 10 to 4000 Pa, more preferably 50 to 1000 Pa, even more preferably 100 to 800 Pa, and even more preferably 150 to 700 Pa.

The amount of water vapor with which the raw material fats and oils are brought into contact is preferably 0.1 to 20% by mass/hr, more preferably 0.2 to 10% by mass/hr, even more preferably 0.3 to 5% by mass/hr, and even more preferably 0.4 to 4% by mass/hr, relative to the raw material fats and oils. Herein, the term "% by mass" refers to a part by mass of water vapor relative to 100 parts by mass of the raw material fats and oils, i.e., an outer percentage (the same applies in the following).

The step (1) of the manufacturing method of the present invention includes carrying out an adsorption treatment of bringing fats and oils into contact with clay (A) and at least one kind of alkaline earth metal salt (B) selected from the group consisting of an oxide, a carbonate, and a silicate of an alkaline earth metal. In this treatment, the order of the contact with the clay (A) and the alkaline earth metal salt (B) is not particularly limited, and the components may be fed in an appropriate order, or may be fed simultaneously. Specifically, there may be given:

(i) bringing fats and oils into contact with clay and subsequently bringing the fats and oils with an alkaline earth metal salt;

(ii) bringing fats and oils into contact with an alkaline earth metal salt and subsequently bringing the fats and oils with clay; and (iii) bringing fats and oils into contact with clay and an alkaline earth metal salt fed simultaneously. Note that a filtration step may be carried out between the contact operations in the methods (i) and (ii) to separate the components by filtration before the next operation.

A method for bringing fats and oils into contact with the components is not particularly limited, and examples thereof include: a method involving adding all components in a stirring bath and stirring and mixing the components; and a method involving filling a column with clay and/or an alkaline earth metal salt and passing fats and oils through the column.

The clay (A) used in the manufacturing method of the present invention may be acid clay, activated clay, or a mixture thereof. The activated clay is a product obtained by treating naturally occurring acid clay (montmorillonite clay) with a mineral acid such as sulfuric acid, and is a compound having a porous structure with a large specific surface area and adsorption capability. It is known that, when the acid clay is treated with an acid, the specific surface area, the pH of a water dispersion, and the like, are changed, thereby changing its properties. The specific surface area of the acid clay or activated clay varies depending on the degree of the acid treatment and the like, and is preferably 50 to 400 $m^2/g$. The pH of the acid clay or activated clay (5% suspension) is preferably 2.5 to 9 and more preferably 3 to 7.

Examples of the acid clay which may be used include commercially available products such as MIZUKA ACE #20 and MIZUKA ACE #400 (both of which are manufactured by MIZUSAWA INDUSTRIAL CHEMICALS, LTD.), and examples of the activated clay which may be used include commercially available products such as GALLEON EARTH V2R, GALLEON EARTH NV, and GALLEON EARTH GSF (all of which are manufactured by MIZUSAWA INDUSTRIAL CHEMICALS, LTD.).

The amount of the clay (A) used is preferably less than 2.0 parts by mass (hereinafter, simply referred to as "parts"), more preferably 1.5 parts or less, and even more preferably 1.3 parts or less, relative to 100 parts of fats and oils from the viewpoints of increasing a filtration rate and improving the productivity, the viewpoint of reducing the content of by-products, and the viewpoint of increasing the yield of fats and oils after the treatment. In addition, the lower limit of the amount of the clay (A) used is preferably 0.1 part or more, more preferably 0.2 part or more, and even more preferably 0.3 part or more, relative to 100 parts of fats and oils from the same viewpoints as in the case of the upper limit. More specifically, the amount of the clay (A) used is preferably 0.1 to less than 2.0 parts, more preferably 0.2 to 1.5 parts, and even more preferably 0.3 to 1.3 parts, relative to 100 parts of fats and oils.

The temperature at which the fats and oils are brought into contact with the clay (A) is preferably 20 to 150° C., more preferably 40 to 135° C., and even more preferably 60 to 120° C., from the viewpoints of reducing the content of by-products and improving industrial productivity. In addition, the time for contact is preferably 3 to 180 minutes, more preferably 5 to 120 minutes, even more preferably 7 to 90 minutes, and even more preferably 15 to 90 minutes, from the same viewpoints. The pressure may be reduced pressure or normal pressure, and is preferably reduced pressure from the viewpoints of suppressing oxidation and improving decoloring property.

The alkaline earth metal salt (B) used in the manufacturing method of the present invention is at least one kind selected from the group consisting of an oxide, a carbonate, and a silicate of an alkaline earth metal. In this case, examples of the alkaline earth metal oxide include calcium oxide (CaO) and magnesium oxide (MgO). Examples of the alkaline earth metal carbonate include calcium carbonate ($CaCO_3$) and magnesium carbonate ($MgCO_3$). Examples of the alkaline earth metal silicate include calcium silicate and magnesium silicate. Note that these alkaline earth metal salts may be used in various crystalline forms or as various hydrates.

Among them, from the viewpoint of improving the taste and flavor, the alkaline earth metal oxide and alkaline earth metal silicate are preferred, and the alkaline earth metal silicate is more preferred. Specifically, calcium oxide, magnesium oxide, and calcium silicate are preferred, and calcium silicate is more preferred. These compounds may be used singly or in combination of two or more kinds thereof.

More specifically, for example, commercially available products such as food additive calcium silicate (manufactured by Tomita Pharmaceutical Co., Ltd.) and food additive magnesium oxide DS (manufactured by Tomita Pharmaceutical Co., Ltd.) may be used.

In the adsorption treatment, the fats and oils may be brought into contact with a metal oxide (C) such as silica, alumina, aluminosilicate, or zeolite together with the alkaline earth metal salt (B).

The mass ratio of the metal oxide to the alkaline earth metal salt ((C)/(B)) is preferably 0.1 to 10, more preferably 0.5 to 8, and even more preferably 1 to 7. In addition, in order to improve the filtration performance, the components may be used in combination with a filter aid such as diatomite.

The lower limit of the amount of the alkaline earth metal salt (B) used is preferably 0.1 part or more, more preferably 0.2 part or more, and even more preferably 0.3 part or more, relative to 100 parts of fats and oils from the viewpoint of improving the taste and flavor, the viewpoints of increasing a filtration rate and improving the productivity, and the viewpoint of increasing the yield. In addition, the upper limit of the amount of the alkaline earth metal salt (B) used is preferably 10 parts or less, more preferably 5 parts or less, and even more preferably 3 parts or less, relative to 100 parts of fats and oils from the same viewpoints as in the case of the lower limit. Specifically, the amount of the alkaline earth metal salt (B) used is preferably 0.1 to 10 parts, more preferably 0.2 to 5 parts, and even more preferably 0.3 to 3 parts, relative to 100 parts of fats and oils.

The temperature at which the fats and oils are brought into contact with the alkaline earth metal salt (B) is preferably 20 to 150° C., more preferably 30 to 135° C., and even more preferably 50 to 120° C., from the viewpoints of reducing the content of by-products and improving industrial productivity. In addition, the time for contact is preferably 3 to 180 minutes, more preferably 5 to 120 minutes, even more preferably 7 to 90 minutes, and even more preferably 15 to 90 minutes, from the same viewpoints. The pressure may be reduced pressure or normal pressure, and is preferably normal pressure from the viewpoints of improving the taste and flavor and suppressing smoke generation when the fats and oils are heated.

In the present invention, the adsorption treatment of bringing the fats and oils into contact with the alkaline earth metal salt (B) (step (1)) is preferably carried out in the presence of water from the viewpoints of improving the taste and flavor and suppressing smoke generation when the fats and oils are heated. The amount of the water is 5 parts or less, more preferably 0.1 to 4 parts, even more preferably 0.1 to 3 parts, even more preferably 0.1 to 2 parts, and even more preferably 0.2 to 1.5 parts, relative to 100 parts of fats and oils, from the same viewpoints. The water may be any of distilled water, ion-exchanged water, tap water, and well water.

In the present invention, subsequently, a step of bringing the fats and oils into contact with water vapor under the condition of 180° C. or less (step (2)), i.e., a deodorization treatment is carried out.

In the manufacturing method of the present invention, the deodorization treatment can be carried out using the same apparatus as in the above-mentioned preliminary deodorization treatment.

In the deodorization treatment, the temperature at which the fats and oils are brought into contact with water vapor is 180° C. or less from the viewpoints of reducing the content of by-products, improving the efficiency of the treatment, and improving the taste and flavor, but the temperature is preferably 175° C. or less and more preferably 170° C. or less, from the same viewpoints. In addition, the lower limit of the temperature at which the fats and oils are brought into contact with water vapor is preferably 100° C. or more, more preferably 110° C. or more, and even more preferably 120° C. or more. Specifically, the temperature is preferably 100 to 180° C., more preferably 110 to 175° C., and even more preferably 120 to 170° C. Note that, in the present invention, the temperature at which the fats and oils are brought into contact with water vapor is the temperature of the fats and oils to be brought into contact with water vapor.

The time for which the fats and oils are brought into contact with water vapor is preferably 0.5 to 180 minutes, more preferably 2 to 120 minutes, even more preferably 5 to 90 minutes, and even more preferably 10 to 80 minutes, from the viewpoints of improving the efficiency of treatment and the taste and flavor.

The pressure at which the fats and oils are brought into contact with water vapor is preferably 10 to 4000 Pa, more preferably 50 to 1000 Pa, even more preferably 100 to 800 Pa, and even more preferably 150 to 700 Pa from the same viewpoints.

The amount of the water vapor with which the fats and oils are brought into contact is preferably 0.1 to 20%/hr, more preferably 0.2 to 10%/hr, even more preferably 0.3 to 5%/hr, and even more preferably 0.4 to 4%/hr, relative to the fats and oils.

In the manufacturing method of the present invention, a refining step, which is generally used for fats and oils, may be carried out before and/or after the steps (1) and (2) of the present invention. Specific examples thereof include a top cut distillation step, an acid treatment step, and a water washing step. The top cut distillation step refers to a step of distillation of fats and oils, thereby removing light weight by-products such as fatty acids from the fats and oils.

The acid treatment step refers to a step of adding a chelating agent such as citric acid to fats and oils, followed by mixing.

The water washing step refers to a step of carrying out an operation of bringing fats and oils into contact with water, thereby performing oil-water separation. Water washing can remove water-soluble by-products. The water washing step is preferably repeated more than once (for example, three times).

As a result of the treatments (steps (1) and (2)) of the present invention, generation of by-products, in particular, generation of glycidol fatty acid esters in the refining step can be suppressed, thereby manufacturing refined fats and oils with less by-products, good taste and flavor and hue, and reduced smoke generation when heated. According to the treatments of the present invention, it is possible to suppress generation of by-products throughout the manufacturing steps.

Glycidol fatty acid esters can be measured by a method according to the Deutsche Gesellschaft für Fettwissenschaft standard method C-III 18(09) (DGF Standard Methods 2009 (14. Supplement), C-III 18(09), "Ester-bound 3-chloropropane-1,2-diol (3-MCPD esters) and glycidol (glycidyl esters)"). This measurement method is a measurement method for 3-chloropropane-1,2-diol esters (MCPD esters) and for glycidol and esters thereof. In the present invention, the method of Option A described in Section 7.1 of the Standard Methods ("7.1 Option A: Determination of the sum of ester-bound 3-MCPD and glycidol") is used to quantify glycidol esters. The details of the measurement method are described in Examples.

Glycidol fatty acid esters and MCPD esters are different substances, but, in the present invention, each value obtained by the above-mentioned measurement method is defined as the content of glycidol fatty acid esters.

The content of the glycidol fatty acid esters in the refined fats and oils of the present invention is preferably 7 ppm or less, more preferably 3 ppm or less, even more preferably 1 ppm or less, even more preferably 0.5 ppm or less, and even more preferably 0.3 ppm or less.

The smoke temperature of the refined fats and oils of the present invention is preferably 200° C. or more, more preferably 210° C. or more, even more preferably 215° C. or more, and even more preferably 220° C. or more in terms of a temperature measured by the method described in Examples, from the viewpoint of improving cooking efficiency.

Further, the content of the diacylglycerols in the refined fats and oils of the present invention is preferably 20% or more, more preferably 30% or more, even more preferably 50% or more, and even more preferably 70% or more. The upper limit of the content is not particularly defined, and is preferably 99% or less, more preferably 98% or less, and even more preferably 97% or less.

The hue of the refined fats and oils of the present invention is preferably 30 or less, more preferably 25 or less, and even more preferably 20 or less in terms of a 10R+Y value as measured by the method described in Examples.

An antioxidant can be added to the refined fats and oils of the present invention as is the case with general edible fats and oils, for the purpose of improving storage stability and taste and flavor stability. Examples of the antioxidant include natural antioxidants, tocopherol, ascorbyl palmitate, ascorbyl stearate, BHT, BHA, and phospholipids.

The refined fats and oils of the present invention can be used in exactly the same applications as general edible fats and oils, and can be widely applied to various foods and beverages in which fats and oils are used. For example, the refined fats and oils of the present invention can be used in: oil-in-water fat and oil processed foods such as drinks, desserts, ice creams, dressings, toppings, mayonnaises, and grilled meat sauces; water-in-oil fat and oil processed foods such as margarines and spreads; processed fat and oil foods such as peanut butters, frying shortenings, and baking shortenings; processed foods such as potato chips, snacks, cakes, cookies, pies, breads, and chocolates; bakery mixes; processed meat products; frozen entrees; and frozen foods.

The present invention further discloses the following manufacturing method with respect to the above-mentioned embodiments.

<1> A method for manufacturing refined fats and oils, including: (1) carrying out an adsorption treatment of bringing fats and oils into contact with clay (A) and at least one kind of alkaline earth metal salt (B) selected from the group consisting of an oxide, a carbonate, and a silicate of an alkaline earth metal; and (2) subsequently carrying out a deodorization treatment of bringing the resultant fats and oils into contact with water vapor at 180° C. or less.

<2> The manufacturing method according to the above-mentioned item <1>, in which the fats and oils include fats and oils containing triacylglycerols or diacylglycerols.

<3> The manufacturing method according to the above-mentioned item <1> or <2>, in which the fats and oils contain diacylglycerols in an amount of 20% or more, preferably 50% or more, and more preferably 70% or more.

<4> The manufacturing method according to any one of the above-mentioned items <1> to <3>, in which the fats and oils contain diacylglycerols in an amount of 20 to 99%, preferably 50 to 99%, and more preferably 70 to 99%.

<5> The manufacturing method according to any one of the above-mentioned items <1> to <4>, in which the fats and oils include fats and oils obtained by one of an esterification reaction and a glycerolysis reaction from raw material fats and oils subjected to a preliminary deodorization treatment at 180 to 250° C.

<6> The manufacturing method according to any one of the above-mentioned items <1> to <5>, in which the step (1) is (i) a treatment including bringing fats and oils into contact with clay and subsequently bringing the fats and oils into contact with an alkaline earth metal salt, (ii) a treatment including bringing fats and oils into contact with an alkaline earth metal salt and subsequently bringing the fats and oils into contact with clay, or (iii) a treatment of bringing fats and oils into contact with clay and an alkaline earth metal salt fed simultaneously.

<7> The manufacturing method according to any one of the above-mentioned items <1> to <6>, in which the clay (A) is acid clay, activated clay, or a mixture thereof.

<8> The manufacturing method according to any one of the above-mentioned items <1> to <7>, in which the clay (A) is acid clay or activated clay which has a specific surface area of 50 to 400 $m^2/g$ and has a pH of 2.5 to 9 in a form of a 5% suspension.

<9> The manufacturing method according to any one of the above-mentioned items <1> to <8>, in which the amount of the clay (A) used in the adsorption treatment is less than 2 parts, preferably 1.5 parts or less, and more preferably 1.3 parts or less, relative to 100 parts of the fats and oils, and the lower limit of the amount of the clay (A) used is 0.1 part or more, preferably 0.2 part or more, and more preferably 0.3 part or more, relative to 100 parts of the fats and oils.

<10> The manufacturing method according to any one of the above-mentioned items <1> to <9>, in which the amount of the clay (A) used in the adsorption treatment is 0.1 part or more and less than 2.0 parts, preferably 0.2 to 1.5 parts, and more preferably 0.3 to 1.3 parts, relative to 100 parts of the fats and oils.

<11> The manufacturing method according to any one of the above-mentioned items <1> to <10>, in which the temperature at which the fats and oils are brought into contact with the clay (A) is 20 to 150° C., preferably 40 to 135° C., and more preferably 60 to 120° C.

<12> The manufacturing method according to any one of the above-mentioned items <1> to <11>, in which the time for which the fats and oils are brought into contact with the clay (A) is 3 to 180 minutes, preferably 5 to 120 minutes, more preferably 7 to 90 minutes, and even more preferably 15 to 90 minutes.

<13> The manufacturing method according to any one of the above-mentioned items <1> to <12>, in which the alkaline earth metal salt (B) includes an alkaline earth metal silicate.

<14> The manufacturing method according to any one of the above-mentioned items <1> to <12>, in which the alkaline earth metal salt (B) includes one kind or two or more kinds selected from the group consisting of calcium oxide, magnesium oxide, calcium carbonate, magnesium carbonate, calcium silicate, and magnesium silicate, preferably one kind or two or more kinds selected from the group consisting of calcium oxide, magnesium oxide, and calcium silicate, and more preferably calcium silicate.

<15> The manufacturing method according to any one of the above-mentioned items <1> to <14>, in which the adsorption treatment includes bringing fats and oils into contact with silica, alumina, aluminosilicate, or zeolite together with the alkaline earth metal salt (B).

<16> The manufacturing method according to any one of the above-mentioned items <1> to <15>, in which the lower limit of the amount of the alkaline earth metal salt (B) used is 0.1 part or more, preferably 0.2 part or more, and more preferably 0.3 part or more, relative to 100 parts of the fats and oils, and the upper limit of the amount of the alkaline earth metal salt (B) used is 10 parts or less, preferably 5 parts or less, and more preferably 3 parts or less, relative to 100 parts of the fats and oils.

<17> The manufacturing method according to any one of the above-mentioned items <1> to <16>, in which the amount of the alkaline earth metal salt (B) used is 0.1 to 10 parts, preferably 0.2 to 5 parts, and more preferably 0.3 to 3 parts, relative to 100 parts of the fats and oils.

<18> The manufacturing method according to any one of the above-mentioned items <1> to <17>, in which the temperature at which the fats and oils are brought into contact with the alkaline earth metal salt (B) is 20 to 150° C., preferably 30 to 135° C., and more preferably 50 to 120° C.

<19> The manufacturing method according to any one of the above-mentioned items <1> to <18>, in which the time for which the fats and oils are brought into contact with the alkaline earth metal salt (B) is 3 to 180 minutes, preferably 5 to 120 minutes, more preferably 7 to 90 minutes, and even more preferably 15 to 90 minutes.

<20> The manufacturing method according to any one of the above-mentioned items <1> to <19>, in which the adsorption treatment of bringing the fats and oils into contact with the alkaline earth metal salt (B) is carried out in the presence of water.

<21> The manufacturing method according to the above-mentioned item <20>, in which the amount of the water in the adsorption treatment is 5 parts or less, preferably 0.1 to 4 parts, more preferably 0.1 to 3 parts, even more preferably 0.1 to 2 parts, and even more preferably 0.2 to 1.5 parts, relative to 100 parts of the fats and oils.

<22> The manufacturing method according to any one of the above-mentioned items <1> to <21>, in which the temperature at which the fats and oils are brought into contact with water vapor in the deodorization treatment is 100 to 180° C., preferably 110 to 175° C., and more preferably 120 to 170° C.

<23> The manufacturing method according to any one of the above-mentioned items <1> to <22>, in which the time for which the fats and oils are brought into contact with the water vapor in the deodorization treatment is 0.5 to 180 minutes, preferably 2 to 120 minutes, more preferably 5 to 90 minutes, and even more preferably 10 to 80 minutes.

<24> The manufacturing method according to any one of the above-mentioned items <1> to <23>, in which the pressure at which the fats and oils are brought into contact with water vapor in the deodorization treatment is 10 to 4000 Pa, preferably 50 to 1000 Pa, more preferably 100 to 800 Pa, and even more preferably 150 to 700 Pa.

<25> The manufacturing method according to any one of the above-mentioned items <1> to <24>, in which the amount of the water vapor with which the fats and oils are brought into contact in the deodorization treatment is 0.1 to 20%/hr, preferably 0.2 to 10%/hr, more preferably 0.3 to 56/hr, and even more preferably 0.4 to 4%/hr, relative to the fats and oils.

<26> The manufacturing method according to any one of the above-mentioned items <1> to <25>, in which the content of glycidol fatty acid esters in the resultant refined fats and oils is 7 ppm or less, preferably 3 ppm or less, more preferably 1 ppm or less, even more preferably 0.5 ppm or less, and even more preferably 0.3 ppm or less in terms of the amount of MCPD esters as measured by a method according to the Deutsche Gesellschaft für Fettwissenschaft standard method C-III 18(09).

<27> The manufacturing method according to any one of the above-mentioned items <1> to <26>, in which the smoke temperature of the resultant refined fats and oils is 200° C. or more, preferably 210° C. or more, more preferably 215° C. or more, and even more preferably 220° C. or more.

<28> The manufacturing method according to any one of the above-mentioned items <1> to <27>, in which the hue of the resultant refined fats and oils is 30 or less, preferably 25 or less, and more preferably 20 or less in terms of a 10R+Y value.

EXAMPLES (Method for analysis)

(i) Measurement of Glycidol Fatty Acid Esters (in Compliance with Option A of Deutsche Gesellschaft Für Fettwissenschaft (DGF) Standard Method C-III 18(09))

Approx. 100 mg of a fat and oil sample were weighed in a test tube with a lid. 50 μL of an internal standard substance (3-MCPD-d5/t-butyl methyl ether), 500 μL of a mixed solution of t-butyl methyl ether/ethyl acetate (volume ratio of 8 to 2), and 1 mL of 0.5 N sodium methoxide were added to the fat and oil sample, followed by stirring, and the whole was left to stand still for 10 minutes. 3 mL of hexane and 3 mL of a 3.3% acetic acid/20% sodium chloride aqueous solution were added thereto, followed by stirring, and the upper layer of the mixture was then removed. 3 mL of hexane were further added, followed by stirring, and the upper layer of the mixture was then removed. 250 μL of a mixed solution of 1 g of phenylboronic acid and 4 mL of 95% acetone were added, followed by stirring, and the test tube was hermetically sealed and heated at 80° C. for 20 minutes. 3 mL of hexane were added to the whole, followed by stirring, and the upper layer of the resultant mixture was subjected to measurement with a gas chromatograph-mass spectrometer (GC-MS) to quantify glycidol fatty acid esters.

(ii) Glyceride Composition of Fats and Oils

Approx. 10 mg of a fat and oil sample and 0.5 mL of a trimethylsilylating agent ("Silylating Agent TH" manufactured by Kanto Chemical Co., Inc.) were loaded into a glass sample bottle, and the glass sample bottle was hermetically sealed, and heated at 70° C. for 15 minutes. 1.0 mL of water and 1.5 mL of hexane were added thereto, followed by shaking. After standing still, the upper layer was subjected to gas chromatography (GLC) for analysis.

(iii) Hue Measurement

The color of the refined fats and oils means a value obtained by performing measurement with a 5.25-inch cell by using a Lovibond colorimeter according to "Color (2.2.1-1996)" in "Standard methods for the Analysis of Fats, Oils and Related Materials, Edition 2003" edited by Japan Oil Chemists' Society and making a calculation based on the following Equation (1).

$$\text{Color}=10R+Y \quad (1)$$

(In the equation, R represents a red value and Y represents a yellow value.)

[Taste and Flavor]

The evaluation of taste and flavor of the refined fats and oils was performed by panelists consisting of five members. Each member ate 1 to 2 g of the refined fats and oils raw, and performed a sensory evaluation based on the criteria shown below. The average of the five evaluations was rounded off to the nearest whole number.

(Criteria for Evaluation of Taste and Flavor)

5: Very good
4: Good
3: Slightly good
2: Poor
1: Very poor (Measurement of Smoke Temperature)

The smoke point of the refined fats and oils was measured using a Cleveland open cup flash point tester in accordance with "Smoke point, flash point, and fire point (2.2.11, 1-1996)" in "Standard methods for the Analysis of Fats, Oils and Related Materials, Edition 2003" edited by Japan Oil Chemists' Society.

(Preparation of fats and oils 1) 100 parts by mass of mixed fatty acids (soybean oil fatty acids: rapeseed oil fatty acids=7:3 (mass ratio)), the fatty acids being obtained from the corresponding undeodorized raw material fats and oils, and 15 parts by mass of glycerin were mixed, and the mixture was subjected to an esterification reaction with an enzyme (immobilized lipase Lipozyme RM IM manufactured by Novozymes Japan Ltd.). From the resultant esterified product, fatty acids and monoacylglycerols were removed by top cut distillation, yielding a DAG deacidified oil a (containing 11% of triacylglycerols, 88% of diacylglycerols, and 1% of monoacylglycerols). The oil contained glycidol fatty acid esters at 1.5 ppm.

(Preparation of fats and oils 2)

Mixed fats and oils (undeodorized soybean oil: undeodorized rapeseed oil=7:3 (mass ratio)) were subjected to a preliminary deodorization treatment under the conditions of a temperature of 230° C., a time of 34 minutes, a pressure of 260 Pa, and water vapor of 3%/hr-relative to the oil, yielding raw material fats and oils. Subsequently, 100 parts by mass of fatty acids obtained by using deodorized fats and oils as raw materials and 15 parts by mass of glycerin were mixed, and the mixture was subjected to an esterification reaction with an enzyme. From the resultant esterified product, fatty acids and monoacylglycerols were removed by top-cut distillation, yielding a DAG deacidified oil b (containing 10% of triacylglycerols, 89% of diacylglycerols, and 1% of monoacylglycerols). The oil contained glycidol fatty acid esters at 1.4 ppm.

(Preparation of fats and oils 3)

Mixed fats and oils (undeodorized soybean oil: undeodorized rapeseed oil=7:3 (mass ratio)) were subjected to a preliminary deodorization treatment under the conditions of a temperature of 200° C., a time of 34 minutes, a pressure of 260 Pa, and water vapor of 3%/hr-relative to the oil, yielding raw material fats and oils. Subsequently, the same operation as in "Preparation of fats and oils 2" was carried out, yielding a DAG deacidified oil c (containing 10% of triacylglycerols, 89% of diacylglycerols, and 1% of monoacylglycerols). The oil contained glycidol fatty acid esters at 1.5 ppm.

(Preparation of fats and oils 4)

Mixed fats and oils (undeodorized soybean oil: undeodorized rapeseed oil=7:3 (mass ratio)) were subjected to a preliminary deodorization treatment under the conditions of a temperature of 230° C., a time of 34 minutes, a pressure of 260 Pa, and water vapor of 3%/hr-relative to the oil, yielding raw material fats and oils. Subsequently, 100 parts by mass of fatty acids obtained by using deodorized fats and oils as raw materials and 15 parts by mass of glycerin were mixed, and the mixture was subjected to an esterification reaction with an enzyme (immobilized lipase). From the resultant esterified product, fatty acids and monoacylglycerols were removed by top-cut distillation, yielding a DAG deacidified oil d (containing 4.8% of triacylglycerols, 94.9% of diacylglycerols, and 0.2% of monoacylglycerols). The oil contained glycidol fatty acid esters at 0.1 ppm.

(Preparation of fats and oils 5)

Mixed fats and oils (undeodorized soybean oil: undeodorized rapeseed oil=7:3 (mass ratio)) were subjected to a preliminary deodorization treatment under the conditions of a temperature of 200° C., a time of 34 minutes, a pressure of 260 Pa, and water vapor of 3%/hr-relative to the oil, yielding raw material fats and oils. Subsequently, the same operation as in "Preparation of fats and oils 4" was carried out, yielding a DAG deacidified oil e (containing 4.7% of triacylglycerols, 95.1% of diacylglycerols, and 0.1% of monoacylglycerols). The oil contained glycidol fatty acid esters at 0.1 ppm.

Examples 1 to 6

(Treatment with clay)

1 part of activated clay (GALLEON EARTH V2R manufactured by MIZUSAWA INDUSTRIAL CHEMICALS, LTD.) was added to 100 parts of the DAG deacidified oil a, b, or c, and the oil was brought into contact with the activated clay with stirring under reduced pressure under the condition (1) shown in Table 1. The activated clay was separated by filtration, yielding a clay-treated fat and oil sample.

(Treatment with Alkaline Earth Metal Salt)

2 parts of an alkaline earth metal salt were added to 100 parts of the clay-treated fat and oil sample, and the sample was brought into contact with the alkaline earth metal salt with stirring under normal pressure under the condition (2) shown in Table 1. The alkaline earth metal salt was separated by filtration, yielding an alkaline earth metal salt-treated fat and oil sample. In Example 4, before addition of the alkaline earth metal salt, 0.5 part of distilled water was added to 100 parts of the clay-treated fat and oil sample.

(Treatment with Acid)

0.5 part of a 50% aqueous solution of citric acid was added to 100 parts of the resultant alkaline earth metal salt-treated fat and oil sample, and the mixture was stirred at 70° C. for 30 minutes, yielding an acid-treated fat and oil sample.

(Water Washing Treatment)

10 parts of distilled water were added to 100 parts of the resultant acid-treated fat and oil sample, and the mixture was stirred at 70° C. for 30 minutes and centrifuged to remove the water phase. The operation was repeated three times, yielding a water-washed fat and oil sample.

(Deodorization Treatment)

The resultant water-washed fat and oil sample was deodorized by the batch method under the condition (3) shown in Table 1. The water-washed fat and oil sample was loaded into a glass Claisen flask, and subsequently brought into contact with water vapor, yielding refined fats and oils. Table 1 shows the results.

Comparative Example 1

Refined fats and oils were obtained in the same manner as in Example 1, except that silica gel (Wako gel C-200 manufactured by Wako Pure Chemical Industries, Ltd.) was used instead of the alkaline earth metal salt. Table 1 shows the results.

Comparative Example 2

(Omission of Treatment with Clay)

2 parts of an alkaline earth metal salt were added to 100 parts of the DAG deacidified oil a, and the oil was brought into contact with the alkaline earth metal salt with stirring under normal pressure under the condition (2) shown in Table 1. The alkaline earth metal salt was separated by filtration, yielding an alkaline earth metal salt-treated fat and oil sample.

Next, the water-washed fat and oil sample obtained by carrying out the treatment with an acid and the water washing treatment in the same manner as in Example 1 was deodorized by the batch method under the condition (3) shown in Table 1. The fat and oil sample was loaded into a glass Claisen flask, and subsequently brought into contact with water vapor, yielding refined fats and oils. Table 1 shows the results.

Comparative Example 3

(Omission of Treatment with Alkali Earth Metal Salt)

In the same manner as in Example 1, the DAG deacidified oil a was treated with clay, and subsequently the clay was separated by filtration, yielding a clay-treated fat and oil sample.

Next, the water-washed fat and oil sample obtained by carrying out the treatment with an acid and the water washing treatment in the same manner as in Example 1 was deodorized by the batch method under the condition (3) shown in Table 1. The fat and oil sample was loaded into a glass Claisen flask, and subsequently brought into contact with water vapor, yielding refined fats and oils. Table 1 shows the results.

TABLE 1

| | | Example 1 | Example 2 | Example 3 | Example 4 | Example 5 | Example 6 | Comparative Example 1 | Comparative Example 2 | Comparative Example 11 |
|---|---|---|---|---|---|---|---|---|---|---|
| DAG deacidified oil | | a | a | b | b | c | b | a | a | a |
| Treatment with clay Condition (1) | Temperature [° C.] | 110 | 110 | 110 | 110 | 110 | 110 | 110 | None | 110 |
| | Contact time [min] | 20 | 20 | 20 | 20 | 20 | 20 | 20 | | 20 |
| | Amount of clay used [part] | 1 | 1 | 1 | 1 | 1 | 1 | 1 | | 1 |
| Treatment with alkaline earth metal salt Condition (2) | Temperature [° C.] | 70 | 70 | 70 | 70 | 70 | 70 | 70 | 70 | None |
| | Contact time [min] | 60 | 60 | 60 | 60 | 60 | 60 | 60 | 60 | |
| | Type of alkaline earth metal salt | Calcium silicate*1 | Magnesium oxide*2 | Calcium silicate*1 | Calcium silicate*1 | Calcium silicate*1 | Calcium silicate*1 | Silica Gel*3 | Calcium silicate*1 | |
| | Amount of alkaline earth metal salt used [parts] | 2 | 2 | 2 | 2 | 2 | 2 | 2 | 2 | |
| | Amount of water added [part(s)] | 0 | 0 | 0 | 0.5 | 0 | 0 | 0 | 0 | |
| Deodorization treatment Condition (3) | Temperature [° C.] | 150 | 150 | 150 | 150 | 150 | 180 | 150 | 150 | 150 |
| | Pressure [Pa] | 260 | 260 | 260 | 260 | 260 | 260 | 260 | 260 | 260 |
| | Contact time [min] | 60 | 60 | 60 | 60 | 60 | 60 | 60 | 60 | 60 |
| | Amount of water vapor [%/hr-relative to oil] | 3 | 3 | 3 | 3 | 3 | 3 | 3 | 3 | 3 |
| Analysis value | DAG [° C.] | 88 | 88 | 89 | 89 | 89 | 89 | 88 | 88 | 88 |
| | Hue 10R + Y | 22 | 23 | 16 | 16 | 19 | 16 | 23 | 34 | 23 |
| | Glycidol fatty acid esters [ppm] | 0.2 | 0.2 | 0.2 | 0.2 | 0.2 | 0.6 | 0.2 | 1.4 | 0.2 |

TABLE 1-continued

| | | Example 1 | Example 2 | Example 3 | Example 4 | Example 5 | Example 6 | Comparative Example 1 | Comparative Example 2 | Comparative Example 11 |
|---|---|---|---|---|---|---|---|---|---|---|
| Evaluation of taste and flavor | 5 (good) ⟷ 1 (poor) | 4 | 4 | 5 | 5 | 4 | 5 | 3 | 3 | 2 |
| Smoke temperature [° C.] | | 215 | 225 | 215 | 220 | 215 | 220 | 210 | 215 | 205 |

*1Food additive calcium silicate (manufactured by Tomita Pharmaceutical Co., Ltd.)
*2Food additive magnesium oxide DS (manufactured by Tomita Pharmaceutical Co., Ltd.)
*3Wako gel C-200 (manufactured by Wako Pure Chemical Industries, Ltd.)

As clear from Table 1, refined fats and oils with less glycidol fatty acid esters, good taste and flavor and hue, and reduced smoke generation were able to be obtained by the manufacturing method of the present invention. In addition, when raw material fats and oils subjected to a preliminary deodorization treatment were used as sources of DAG-rich fats and oils, the taste and flavor and hue were additionally improved.

On the other hand, the fats and oils obtained by using silica gel instead of the alkaline earth metal salt (Comparative Example 1) and the fats and oils which were not treated with the alkaline earth metal salt (Comparative Example 3) had poor taste and flavor and had a low smoke temperature. In addition, the fats and oils which were not treated with the clay (Comparative Example 2) had poor hue and poor taste and flavor, and the amount of glycidol fatty acid esters was not able to be sufficiently reduced.

Examples 7 to 9

(Treatment with Clay)

1 part of activated clay (GALLEON EARTH V2R manufactured by MIZUSAWA INDUSTRIAL CHEMICALS, LTD.) was added to 100 parts of the DAG deacidified oil d, and the oil was brought into contact with the activated clay with stirring under reduced pressure under the condition (1) shown in Table 2. The activated clay was separated by filtration, yielding a clay-treated fat and oil sample.

(Treatment with Alkaline Earth Metal Salt)

2 parts of an alkaline earth metal salt were added to 100 parts of the clay-treated fat and oil sample, and the sample was brought into contact with the alkaline earth metal salt with stirring under nitrogen at normal pressure under the condition (2) shown in Table 2. The alkaline earth metal salt was separated by filtration, yielding an alkaline earth metal salt-treated fat and oil sample.

In Example 8, before addition of the alkaline earth metal salt, 2 parts of distilled water were added to 100 parts of the clay-treated fat and oil sample.

(Treatment with Acid)

0.5 part of a 50% aqueous solution of citric acid was added to 100 parts of the resultant alkaline earth metal salt-treated fat and oil sample, and the mixture was stirred at 70° C. for 30 minutes, yielding an acid-treated fat and oil sample.

(Water Washing Treatment)

10 parts of distilled water were added to 100 parts of the resultant acid-treated fat and oil sample, and the mixture was stirred at 70° C. for 30 minutes and centrifuged to remove the water phase. The operation was repeated three times, yielding a water-washed fat and oil sample.

(Deodorization treatment)

The resultant water-washed fat and oil sample was deodorized by the batch method under the condition (3) shown in Table 2. The water-washed fat and oil sample was loaded into a glass Claisen flask, and subsequently brought into contact with water vapor, yielding refined fats and oils. Table 2 shows the results.

Comparative Example 4

Refined fats and oils were obtained in the same manner as in Example 7, except that sodium hydroxide was used instead of the alkaline earth metal salt. Table 2 shows the results.

Comparative Example 5

Refined fats and oils were obtained in the same manner as in Comparative Example 4, except that 2 parts of distilled water were added to 100 parts of the clay-treated fat and oil sample before addition of sodium hydroxide. Table 2 shows the results.

Example 10

Refined fats and oils were obtained under the same conditions as in Example 9, except that the DAG deacidified oil e was used. Table 2 shows the results.

Example 11

Refined fats and oils were obtained under the same conditions as in Example 9, except that the DAG deacidified oil e was used, and 0.5 part of distilled water was added to 100 parts of the clay-treated fat and oil sample before addition of the alkaline earth metal salt. Table 2 shows the results.

TABLE 2

| | | Example 7 | Example 8 | Example 9 | Comparative Example 4 | Comparative Example 5 | Example 10 | Example 11 |
|---|---|---|---|---|---|---|---|---|
| DAG deacidified oil | | d | d | d | d | d | e | e |
| Treatment with clay Condition (1) | Temperature [° C.] | 110 | 110 | 110 | 110 | 110 | 110 | 110 |
| | Contact time [min] | 20 | 20 | 20 | 20 | 20 | 20 | 20 |
| | Amount of clay used [part] | 1 | 1 | 1 | 1 | 1 | 1 | 1 |

TABLE 2-continued

| | | Example 7 | Example 8 | Example 9 | Comparative Example 4 | Comparative Example 5 | Example 10 | Example 11 |
|---|---|---|---|---|---|---|---|---|
| Treatment with alkaline earth metal salt Condition (2) | Temperature [°C.] | 70 | 70 | 70 | 70 | 70 | 70 | 70 |
| | Contact time [min] | 60 | 60 | 60 | 60 | 60 | 60 | 60 |
| | Type of alkaline earth metal salt | Magnesium silicate*4 | Calcium silicate*1 | Calcium silicate*1 | Sodium hydroxide*5 | Sodium hydroxide*5 | Calcium silicate*1 | Calcium silicate*1 |
| | Amount of alkaline earth metal salt used [parts] | 2 | 2 | 2 | 2 | 2 | 2 | 2 |
| | Amount of water added [part(s)] | 0 | 2 | 0 | 0 | 2 | 0 | 0.5 |
| Deodorization treatment Condition (3) | Temperature [° C.] | 150 | 150 | 150 | 150 | 150 | 150 | 150 |
| | Pressure [Pa] | 260 | 260 | 260 | 260 | 260 | 260 | 260 |
| | Contact time [min] | 60 | 60 | 60 | 60 | 60 | 60 | 60 |
| | Amount of water vapor [%/hr-relative to oil] | 3 | 3 | 3 | 3 | 3 | 3 | 3 |
| Analysis value | DAG [° C.] | 93.8 | 93.7 | 93.8 | 92.6 | 66.5 | 93.8 | 93.9 |
| | Hue 10R + Y | 20 | 20 | 20 | 21 | 45 | 22 | 22 |
| | Glycidol fatty acid esters [ppm] | 0.1 | 0.2 | 0.0 | 0.5 | 0.4 | 0.1 | 0.2 |
| Evaluation of taste and flavor | 5 (good) ⟷ 1 (poor) | 3 | 5 | 5 | 1 | 1 | 4 | 4 |
| Smoke temperature [° C.] | | 205 | 225 | 215 | 190 | 175 | 215 | 220 |

*1Food additive calcium silicate (manufactured by Tomita Pharmaceutical Co., Ltd.)
*4Food additive magnesium silicate (manufactured by Tomita Pharmaceutical Co., Ltd.)
*5Sodium hydroxide (manufactured by Wako Pure Chemical Industries, Ltd.)

As clear from Table 2, refined fats and oils with less glycidol fatty acid esters, good taste and flavor and hue, and reduced smoke generation were able to be obtained by the manufacturing method of the present invention. In addition, when raw material fats and oils subjected to a preliminary deodorization treatment were used as sources of DAG-rich fats and oils, the taste and flavor and hue were additionally improved. Further, the addition of a small amount of water in the adsorption treatment improved the taste and flavor and increased the smoke temperature.

On the other hand, the fats and oils obtained by using sodium hydroxide instead of the alkaline earth metal salt (Comparative Examples 4 and 5) had poor hue and taste and flavor and had a low smoke temperature.

The invention claimed is:

1. A method for manufacturing refined fats and oils, the method comprising:

(1) carrying out an adsorption treatment by bringing fats and oils into contact with clay (A) and at least one kind of an alkaline earth metal salt (B) selected from the group consisting of an oxide, a carbonate, and a silicate of an alkaline earth metal, wherein the alkaline earth metal is calcium silicate; and (2) subsequently carrying out a deodorization treatment by bringing the resultant fats and oils into contact with water vapor at 180° C. or less.

2. The method for manufacturing refined fats and oils according to claim 1, wherein an amount of the clay (A) used in the adsorption treatment is less than 2 parts by mass relative to 100 parts by mass of the fats and oils.

3. The method for manufacturing refined fats and oils according to claim 1, wherein the clay (A) comprises an acid clay, an activated clay, or a mixture thereof.

4. The method for manufacturing refined fats and oils according to claim 1, wherein an amount of the alkaline earth metal salt (B) used in the adsorption treatment is from 0.1 to 10 parts by mass relative to 100 parts by mass of the fats and oils.

5. The method for manufacturing refined fats and oils according to claim 1, wherein the adsorption treatment by bringing the fats and oils into contact with the alkaline earth metal salt (B) is carried out in the presence of water.

6. The method for manufacturing refined fats and oils according to claim 5, wherein an amount of the water in the adsorption treatment is 5 parts by mass or less relative to 100 parts by mass of the fats and oils.

7. The method for manufacturing refined fats and oils according to claim 1, in which the adsorption treatment is (i) a treatment that comprises bringing fats and oils into contact with clay and subsequently bringing the fats and oils into contact with an alkaline earth metal salt, or (ii) a treatment that comprises bringing fats and oils into contact with an alkaline earth metal salt and subsequently bringing the fats and oils into contact with clay.

8. The method for manufacturing refined fats and oils according to claim 1, in which the adsorption treatment is (iii) a treatment by bringing fats and oils into contact with clay and an alkaline earth metal salt fed simultaneously.

9. The method for manufacturing refined fats and oils according to claim 1, in which the clay (A) is an acid clay, an activated clay, or a mixture thereof.

10. The method for manufacturing refined fats and oils according to claim 1, in which the adsorption treatment comprises bringing fats and oils into contact with silica, alumina, aluminosilicate, or zeolite together with the alkaline earth metal salt (B).

11. The method for manufacturing refined fats and oils according to claim 1, in which the temperature at which the fats and oils are brought into contact with the clay (A) is from 20 to 150° C.

12. The method for manufacturing refined fats and oils according to claim 1, in which the temperature at which the fats and oils are brought into contact with the alkaline earth metal salt (B) is from 20 to 150° C.

13. The method for manufacturing refined fats and oils according to claim 1, in which the temperature at which the fats and oils are brought into contact with water vapor in the deodorization treatment is from 120 to 170° C.

14. The method for manufacturing refined fats and oils according to claim 1, wherein the fats and oils contain diacylglycerols in an amount of 20 by mass or more.

15. The method for manufacturing refined fats and oils according to claim 1, wherein the fats and oils contain diacylglycerols in an amount of from 70 to 99 by mass.

16. The method for manufacturing refined fats and oils according to claim 1, wherein the fats and oils comprises fats and oils obtained by an esterification reaction or a glycerolysis reaction from raw material fats and oils subjected to a preliminary deodorization treatment at from 180 to 250° C.

17. The method for manufacturing refined fats and oils according to claim 1, in which the content of glycidol fatty acid esters in the resultant refined fats and oils is 7 ppm or less in terms of the amount of MCPD esters as measured by a method according to the Deutsche Gesellschaft für Fettwissenschaft standard method C-III 18(09).

18. The method for manufacturing refined fats and oils according to claim 1, in which the smoke temperature of the resultant refined fats and oils is 200° C. or more.

19. The method for manufacturing refined fats and oils according to claim 1, wherein the deodorization treatment is carried out by bringing the resultant fats and oils into contact with water vapor at 170° C. or less.

20. The method for manufacturing refined fats and oils according to claim 1, wherein the deodorization treatment is carried out by bringing the resultant fats and oils into contact with water vapor at 150° C. or less.

21. The method for manufacturing refined fats and oils according to claim 1, in which the temperature at which the fats and oils are brought into contact with the alkaline earth metal salt (B) is 150° C. or less.

22. The method for manufacturing refined fats and oils according to claim 1, in which the temperature at which the fats and oils are brought into contact with the alkaline earth metal salt (B) is 135° C. or less.

23. The method for manufacturing refined fats and oils according to claim 1, in which the temperature at which the fats and oils are brought into contact with the clay (A) is 150° C. or less.

24. The method for manufacturing refined fats and oils according to claim 1, in which the temperature at which the fats and oils are brought into contact with the clay (A) is 120° C. or less.

* * * * *